US010784571B2

(12) United States Patent
Crouch et al.

(10) Patent No.: US 10,784,571 B2
(45) Date of Patent: Sep. 22, 2020

(54) DIELECTRIC-ENCAPSULATED WIDEBAND METAL RADOME

(71) Applicant: Raytheon Company, Waltham, MA (US)

(72) Inventors: David D. Crouch, Eastvale, CA (US); Travis B. Feenstra, Calimesa, CA (US); David R. Sar, Corona, CA (US)

(73) Assignee: RAYTHEON COMPANY, Waltham, MA (US)

( * ) Notice: Subject to any disclaimer, the term of this patent is extended or adjusted under 35 U.S.C. 154(b) by 539 days.

(21) Appl. No.: 15/625,280

(22) Filed: Jun. 16, 2017

(65) Prior Publication Data

US 2018/0366821 A1 Dec. 20, 2018

(51) Int. Cl.
*H01Q 1/42* (2006.01)
*H01Q 15/00* (2006.01)

(52) U.S. Cl.
CPC ..... *H01Q 1/425* (2013.01); *H01Q 1/42* (2013.01); *H01Q 15/0013* (2013.01); *H01Q 1/422* (2013.01)

(58) Field of Classification Search
CPC . H01Q 1/425; H01Q 1/28; H01Q 1/40; F42B 10/46
See application file for complete search history.

(56) References Cited

U.S. PATENT DOCUMENTS

| | | | | |
|---|---|---|---|---|
| 3,633,206 | A * | 1/1972 | McMillan | H01Q 19/06 343/754 |
| 4,570,166 | A * | 2/1986 | Kuhn | F42B 10/46 343/872 |
| 5,886,671 | A * | 3/1999 | Riemer | H01Q 1/28 342/368 |
| 6,476,771 | B1 * | 11/2002 | McKinzie, III | H01Q 1/425 333/134 |
| 7,688,278 | B2 | 3/2010 | Frenkel | |
| 8,049,193 | B1 | 11/2011 | Appleby et al. | |
| 8,125,402 | B2 | 2/2012 | Crouch et al. | |
| 2009/0058746 | A1 | 3/2009 | Delgado et al. | |
| 2009/0109115 | A1 * | 4/2009 | Dittrich | H01Q 1/425 343/841 |
| 2009/0167628 | A1 * | 7/2009 | Frenkel | H01Q 1/002 343/872 |
| 2009/0174621 | A1 * | 7/2009 | Crouch | H01Q 1/02 343/872 |

(Continued)

OTHER PUBLICATIONS

Chen, "Transmission of Microwave Through Perforated Flat Plates of Finite Thickness", 1973, IEEE, 6 pages.

(Continued)

*Primary Examiner* — Ricardo I Magallanes
(74) *Attorney, Agent, or Firm* — Cantor Colburn LLP

(57) ABSTRACT

A low-loss millimeter-wave radome is provided. The low-loss millimeter wave radome includes a perforated and plated metallic plate and a low-loss dielectric encapsulation material to encapsulate the perforated and plated metallic plate. The perforated and plated metallic plate includes multiple metallic sheets and electrically conductive plating. The multiple metallic sheets respectively define a periodic array of sub-wavelength holes and are laminated together such that the periodic array of sub-wavelength holes combines into a periodic array of perforations.

8 Claims, 7 Drawing Sheets

(56) References Cited

U.S. PATENT DOCUMENTS

2014/0118218 A1* 5/2014 Jordan ..... H01Q 1/425
343/872

OTHER PUBLICATIONS

Fallah et al., "Designing a Bandpass Frequency Selective Surface Based on an Analytical Approach Using Hexagonal Patch-Strip Unite Cell", 2015, Electromagnetics, 35:1, pp. 25-39.
ISR/WO, dated Aug. 14, 2018, RAY0365PCT, PCT Aapplication No. PCT/US2018/037211, 19 pages (total ISR/WO).

* cited by examiner

DIELECTRIC-ENCAPSULATED WIDEBAND METAL RADOME

BACKGROUND

The present invention relates to electromagnetic windows and radomes and, more specifically, to low-loss wideband millimeter-wave windows and radomes.

Microwave and millimeter-wave systems often require a window or radome to protect electronic equipment from the environment. Such a radome needs to be highly transparent across the operating frequency band such that it exhibits minimal reflection and transmission losses. In many applications, the radome must possess a certain degree of mechanical strength as well. For example, an aircraft radome must be able to withstand the rigors of takeoffs and landings, wind loading during flight and possibly a large pressure differential if the interior of the radome is pressurized.

Conventional wideband radomes are often multilayer dielectric structures in which the dielectric properties and the layer thicknesses are chosen to yield certain performance capabilities over a desired bandwidth. Unfavorable material properties, such as high loss tangents, and tolerance requirements make it difficult to apply this approach at frequencies approaching 100 GHz however.

SUMMARY

According to one embodiment of the present invention, a low-loss millimeter-wave radome is provided. The low-loss millimeter wave radome includes a perforated and plated metallic plate and a low-loss dielectric encapsulation material to encapsulate the perforated and plated metallic plate. The perforated and plated metallic plate includes multiple metallic sheets and electrically conductive plating. The multiple metallic sheets respectively define a periodic array of sub-wavelength holes and are laminated together such that the periodic array of sub-wavelength holes combines into a periodic array of perforations.

According to another embodiment, a low-loss millimeter-wave radome is provided. The low-loss millimeter-wave radome includes first and second perforated and plated metallic plates, first and second low-loss dielectric encapsulation materials to encapsulate the first and second perforated and plated metallic plates, respectively, and a dielectric filler material. The dielectric filler material is interposed between the first perforated metallic plate and low-loss dielectric encapsulation material and the second perforated metallic plate and low-loss dielectric encapsulation material. Each of the first and second perforated and plated metallic plates includes multiple metallic sheets and electrically conductive plating. The multiple metallic sheets of each of the first and second perforated and plated metallic plates respectively define a periodic array of sub-wavelength holes and are laminated together such that the periodic array of sub-wavelength holes combines into a periodic array of perforations.

According to another embodiment, a method of assembling a low-loss millimeter-wave radome is provided. The method includes assembling a perforated and plated metallic plate and encapsulating the perforated and plated metallic plate. The assembling of the perforated and plated metallic plate includes forming multiple metallic sheets to respectively define a periodic array of sub-wavelength holes and laminating the multiple metallic sheets together such that the periodic array of sub-wavelength holes combines into a periodic array of perforations.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

As will be described below, a mechanically robust wideband low-loss radome architecture is provided which is suitable for use at millimeter-wave frequencies approaching and exceeding 100 GHz. That is, the present invention relates to a wideband radome that includes one or more perforated metal plates for use as a low-loss structural backbone. Each plate is a laminated structure that includes multiple thin perforated metal sheets. Each sheet is chemically machined to endow it with a periodic array of sub-wavelength holes. Multiple identical sheets are bonded together (via diffusion bonding, for example) to yield a perforated metal plate. The base metal is chosen for its mechanical properties and then plated with a high-conductivity material such as copper. Plating can occur either before or after the sheets are bonded together to form a plate. To form a window or radome, one or more plates are encapsulated inside a low-loss dielectric material so that even the holes in the plates are filled with dielectric. The low-loss characteristic for the radome architecture is realized by a choice of hole size and shape, array geometry, plate thickness and dielectric properties and thicknesses.

Figure 1A:
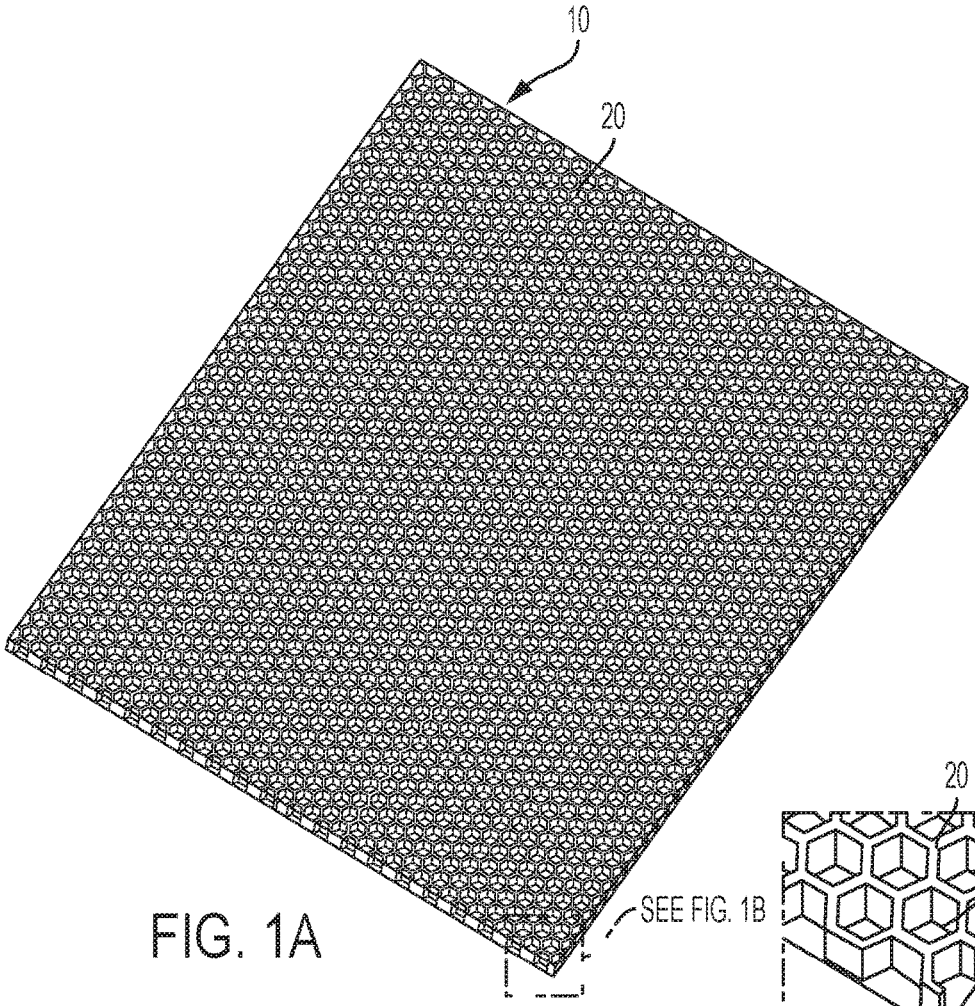
FIG. 1A is an illustration of a section of a wideband metal radome panel in accordance with embodiments.
Figure 1B:
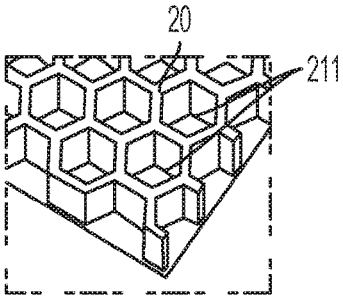
FIG. 1B is an enlarged view of the outlined section of FIG. 1A.
Figure 2:
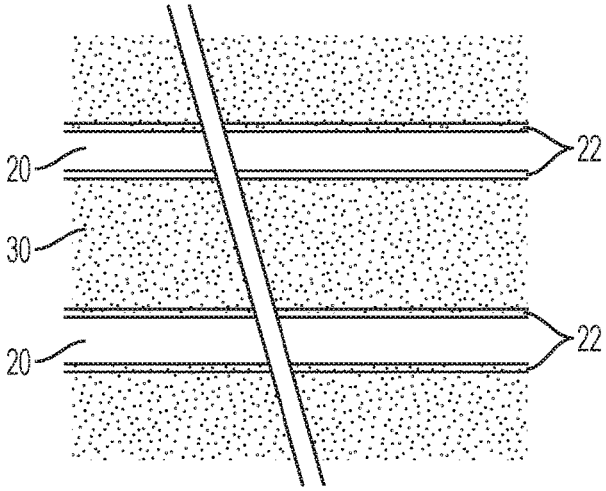
FIG. 2 is an enlarged view of a portion of the section of the wideband metal radome of FIG. 1A.
Figure 3:
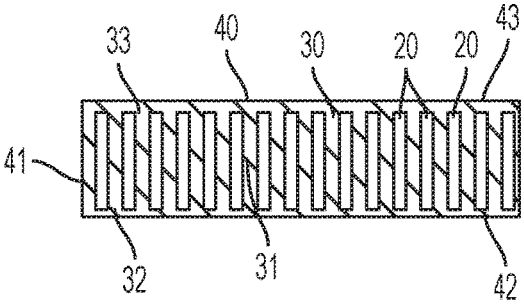
FIG. 3 is a side view of the section of the wideband metal radome of FIG. 1A.

With reference to FIGS. 1-3, a low-loss millimeter-wave radome 10 is provided as a metal-reinforced radome that is capable of wideband operation. The low-loss millimeter-wave radome 10 includes a perforated and plated metallic plate 20 and a low-loss dielectric encapsulation material 30 which is disposed to encapsulate the perforated and plated metallic plate 20. The perforated and plated metallic plate 20 serves as a structural backbone and includes multiple metallic sheets 21 (see FIG. 4) and plating 22. The multiple metallic sheets 21 respectively define a periodic array of sub-wavelength holes 210 (see FIG. 4) and are laminated together in a lamination direction DL (See FIG. 4) such that the periodic array of sub-wavelength holes 210 combines into a periodic array of perforations 211.

The plating 22 may include a high conductivity metallic material to ensure that the plated surfaces have or exhibit relatively high electrical conductivity to minimize radome transmission losses.

The low-loss dielectric encapsulation material 30 fills each of the perforations 211 in the perforated and plated metallic plate 20 with filler material 31 and forms solid layers 32 and 33 parallel to the exterior surfaces of the perforated and plated metallic plate 20. As such, the low-loss dielectric encapsulation material 30 strengthens the overall radome structure and acts as a protective barrier that isolates the volume protected by the radome from the outside environment. Moreover, since the low-loss dielectric encapsulation material 30 fills the perforations 211, due to the reduced effective wavelength of electromagnetic waves within dielectric [$\lambda_{eff}=\lambda_{vac}/\sqrt{(\varepsilon_R)}$], the perforations 211 can be made relatively smaller than they otherwise would be in the absence of the low-loss dielectric encapsulation material 30 and the center-to-center spacing between adjacent perforations 211 can be reduced. Such reductions in perforation 211 size and center-to-center spacing aid in achieving wideband performance.

In accordance with embodiments, the low-loss dielectric encapsulation material 30 may include low-loss cyanate ester resins, which can have dielectric constants of about 2.9 and loss tangents of about 0.005 and have extremely low viscosity at room temperature. A key advantage of many cyanate ester resins is that they are a liquid prior to curing, which simplifies the task of filling the perforations 211 in each perforated and plated metallic plate 20 with dielectric.

The low-loss millimeter-wave radome 10 may further include a non-conductive outer layer 40. This outer layer 40 includes sidewalls 41 and upper and lower plates 42 and 43. The sidewalls 41 lie over corresponding sidewalls of the perforated and plated metallic plate 20 and the low-loss dielectric encapsulation material 30. The upper and lower plates 42 and 43 lie over the solid layers 32 and 33. The outer layer 40 may be formed of a low-loss dielectric coating.

Figure 4:
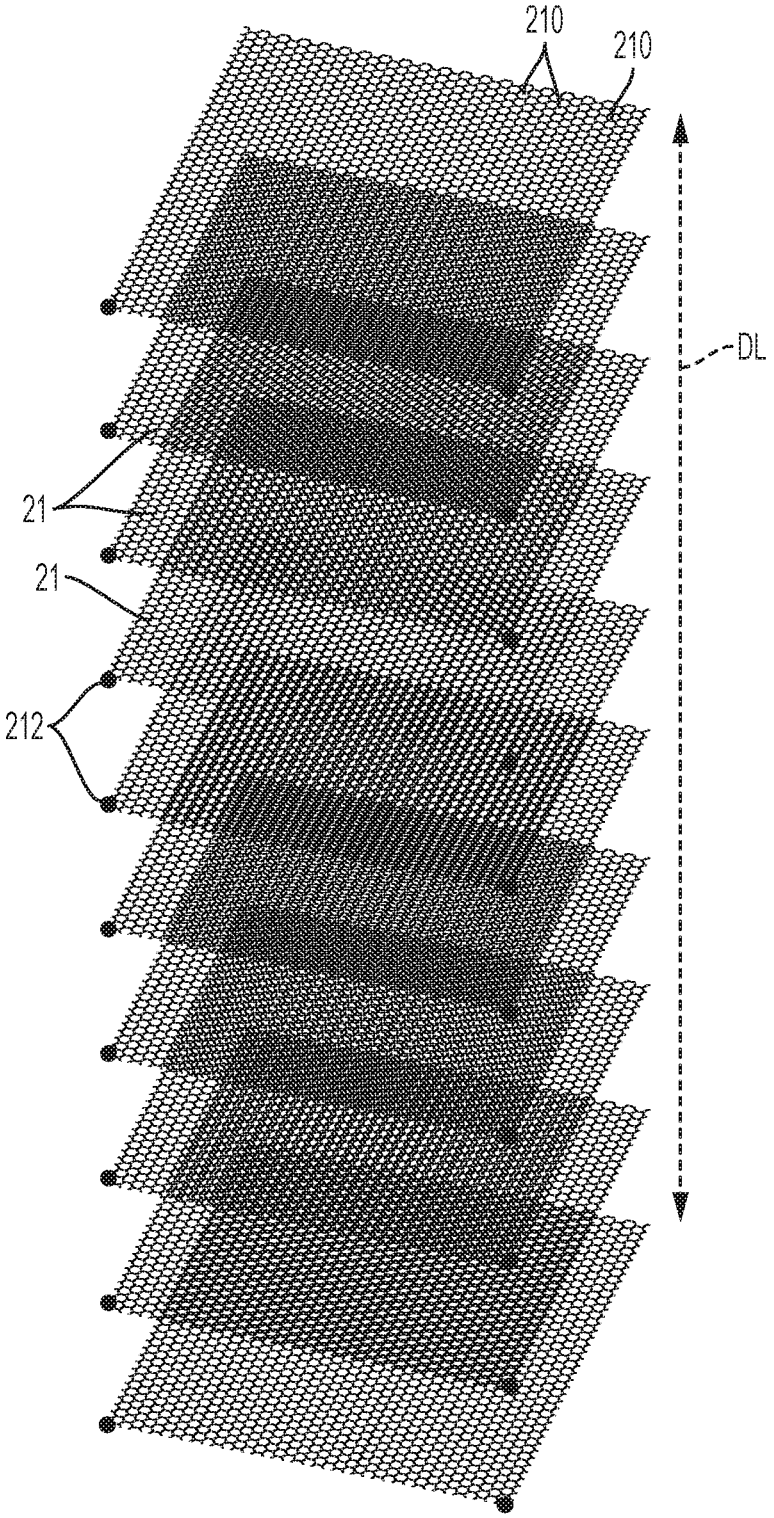
FIG. 4 is an exploded perspective view of a laminated perforated metal plate of 10 sheets that are each about 10 mils thick.

With reference to FIG. 4, a method of assembling the low-loss millimeter-wave radome 10 will now be described.

Conventional numerically-controlled machine tool technology has progressed to the point where it is capable of fabricating intricate structures to precise tolerances. However, it remains the case that the cost of a part scales with the machine time required for its fabrication. With this in mind, it is noted that a large version of the perforated and plated metallic plate 20 of FIGS. 1-3 might contain tens of thousands or hundreds of thousands of perforations 211, all of which must be precisely machined in sequence. Since hole size and separation scale with wavelength, the number of holes needed to cover a radome aperture of fixed size increases with the square of the frequency. Thus, at 75 GHz, for example, a 1 meter square radome aperture is 250 wavelengths on a side. If the center-to-center hole spacing is approximately one-half wavelength, 250,000 individual holes are needed to fill it.

As such, instead of using the conventional numerically-controlled machine tool technology, the present disclosure relies upon the notion of fabricating the perforated and plated metallic plate 20 from the formation and subsequent lamination of the multiple metallic sheets 21 by way of relatively low-cost techniques. That is, once they are formed, the multiple metallic sheets 21 are bonded together and then plated with the high conductivity metal of the plating 22 to thereby yield a robust mechanical structure which is capable of low-loss operation over a wide bandwidth.

In accordance with embodiments, at least two processes are available for creating each of the multiple metallic sheets 21. A first process involves chemical machining or another similar subtractive process whereby the sub-wavelength holes 210 are formed from selective removal of material from an initial metallic sheet. A second process involves electroforming or another similar additive process whereby a precision photo-resist mold is disposed and metallic material is electrochemically deposited thereon to form the metallic material into the desired shape of the multiple metallic sheets 21 with the perforations. Of these processes, chemical machining is relatively low-cost and is suitable for use with a wide variety of base materials whereas electroforming is relatively precise.

In any case, the processes noted above are parallel in nature rather than sequential. Therefore, all the sub-wavelength holes 210 for each of the multiple metallic sheets 21 can be formed simultaneously to significantly reduce time required for fabrication. As a result, the processes noted above offer significant reductions in cost compared to that of traditional machining. Furthermore, both chemical machining and electroforming allow for relative flexibility in perforation shape design.

Once fabricated, the multiple metallic sheets 21 are stacked together using locating features 212 that are built into one or more corners (e.g., two corners) of each individual one of the multiple metallic sheets 21. The multiple metallic sheets 21 are then bonded together to create a substantially uniform structure as shown in FIGS. 1A and 1B. For example, FIGS. 1A and 1B illustrate that a single perforated and plated metallic plate 20 that has a thickness of about 100 mils can be realized by bonding the 10 metallic sheets 21 of FIG. 4 together where each of the 10 metallic sheets 21 has a thickness of 10 mils.

Several methods are available for bonding the multiple metallic sheets 21 together and the method chosen may depend on multiple factors including, but not limited to, the materials of the multiple metallic sheets 21. For example, one method that is applicable for the case of the multiple metallic sheets being formed of stainless steel is diffusion bonding in which high temperature and pressure are applied to bond the multiple metallic sheets 21 into a solid stack. Diffusion bonding requires no flux and thus carries little risk of filler material migrating from between adjacent layers and partially blocking sub-wavelength holes 210 during the bonding process. The diffusion bonding approach tends to yield a relatively high strength structure that has precisely defined and formed features which are suitable for use in the low-loss millimeter-wave radome 10 that cannot be fabricated economically with conventional machine-tool technology.

Encapsulation of the bonded multiple metallic sheets 21 represents a late stage of radome fabrication. Because the low-loss millimeter-wave radome 10 relies on the perforated and plated metallic plate 20 to provide mechanical strength, criteria used to choose the low-loss dielectric encapsulation material 30 can relate to its electrical characteristics rather than its mechanical characteristics. For example, a polymer having a low loss tangent, such as polystyrene, polyethylene and polypropylene, can be used to encapsulate the bonded multiple metallic sheets 21. In any case, encapsulation methods may include injection molding or vacuum injection molding. Injection molding is a process for which polystyrene is well suited and careful injector design is required to ensure that air bubbles are not entrained in the plastic during the injection process. In vacuum injection molding, a vacuum is created in the injection volume prior to injection. Following injection, the vacuum is released while the resin is still fluid, which closes any voids in the plastic.

In accordance with embodiments, additive manufacturing technology may also be employed to form the low-loss millimeter-wave radome 10. For example, 3D printing processes such as selective laser melting (SLM), direct metal laser sintering (DMLS) or electron beam melting (EBM) could be used. Moreover, certain advanced fabrication processes will make it possible to realize three-dimensional radome structures with hemispherical radome shapes, ogive radome shapes and conformal windows and radomes that match the contours of the platform on which they are installed.

Figure 5:
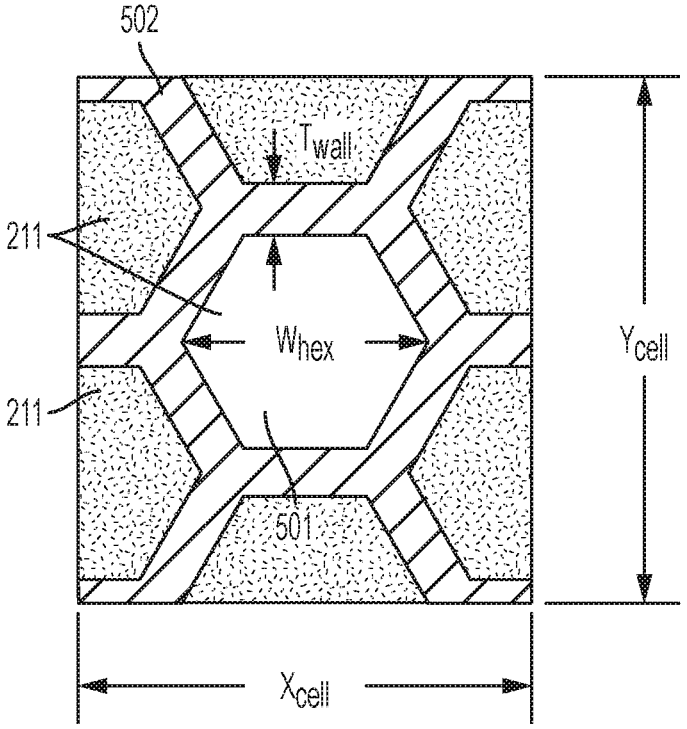
FIG. 5 is a top-down view of a single unit cell of a metal radome in accordance with embodiments.
Figure 6:
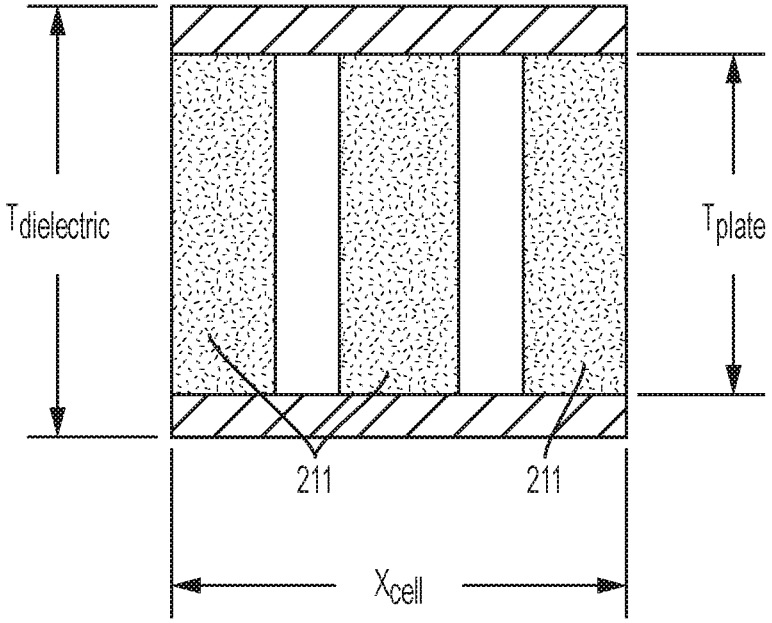
FIG. 6 is a side view of the single unit cell of the metal radome of FIG. 4.

With reference to FIGS. 5 and 6, additional features of the perforated and plated metallic plate 20 will now be described. In particular, it is noted that FIG. 5 illustrates that the perforated and plated metallic plate 20 may be formed such that each perforation 211 or unit cell is provided with a hexagonal shape 501 and is arranged within a hexagonal lattice 502. FIG. 6 illustrates side view of the same perforation 211 or unit cell and shows that the perforated and plated metallic plate 20 is perforated by an array of regular hexagonal perforations 211 which are arranged in a regular hexagonal lattice that corresponds to the formed shape of each of the multiple metallic sheets 21.

In accordance with embodiments, a hexagonal lattice of hexagonal holes such as those of FIGS. 5 and 6 offers certain advantages. These include, but are not limited to, providing a substantially uniform wall thickness between neighboring perforations 211 and thus allowing for perforations 211 to be relatively closely packed (facilitating wideband performance) while maintaining sufficient structural metal between adjacent perforations 211 to provide for structural integrity. Another advantage is azimuthal periodicity in which the lattice and the individual perforations 211 are symmetric with respect to rotations around the surface normal vector that are integer multiples of 60°. This results in less variation in performance with respect to changes in azimuthal angle of incidence.

In accordance with alternative embodiments, it is to be understood that other shapes for the perforations 211 and the overall lattice are possible as long as substantially uniform wall thicknesses with sufficient structural metal and azimuthal periodicity can be reasonably well maintained. For example, the perforations 211 may be shaped as triangles or rectangles and may be arranged in triangular or rectangular lattices, respectively. In accordance with further alternative embodiments, it is to be further understood that the lattice arrangement of the perforations 211 need not be strictly consistent with the shapes of the perforations 211. For example, rectangular perforations 211 could be provided within a triangular lattice by staggering adjacent rows of perforations 211. As another example, the lattice may exhibit certain self-similar patterns that are consistent or inconsistent with those of the perforations 211.

The dimensions of an illustrative embodiment of the present invention with polystyrene encapsulation ($\varepsilon_R$=2.55, tan $\delta$=0.0015) are listed in Table 1.

TABLE 1

| Parameter | Value |
|---|---|
| $X_{cell} = Y_{cell}$* cos(30 deg) | 132.7 mils |
| $Y_{cell}$ | 153.2 mils |
| $T_{wall}$ | 12.5 mils |
| $W_{hex}$ | 74.04 mils |
| $T_{plate}$ | 100 mils |
| $T_{dielectric}$ | 134.7 mils |

Figure 7A:
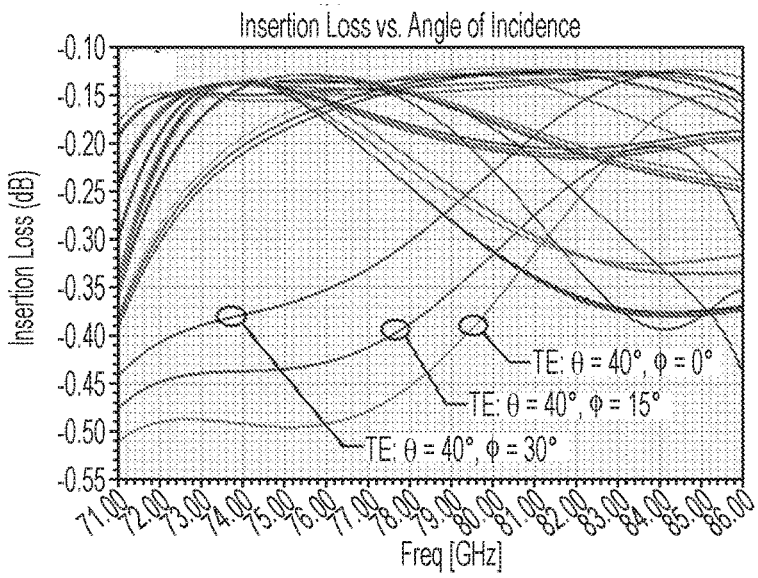
FIG. 7A illustrates insertion loss as a function of frequency for a metal radome.

The radome referred to in Table 1 is designed for low-loss operation between 71 and 86 GHz in particular. Calculated insertion losses for both transverse electric (TE) and transverse magnetic (TM) incident polarizations are plotted in FIG. 7A as functions of frequency and angle of incidence. The angles $\theta$ and $\phi$ represent the angular deviation from normal incidence ($\theta$=0°) and the azimuthal angle of incidence, respectively. The angle $\theta$ is swept from 0° to 40° in 10° increments and, for each value of $\theta$, the TE and TM insertion loss is plotted for $\phi$=0°, 15°, and 30°. Losses are low for both polarizations, with just a slight excursion beyond −0.5 dB when ($\theta$, $\phi$)=(40°, 0°).

Figure 7B:
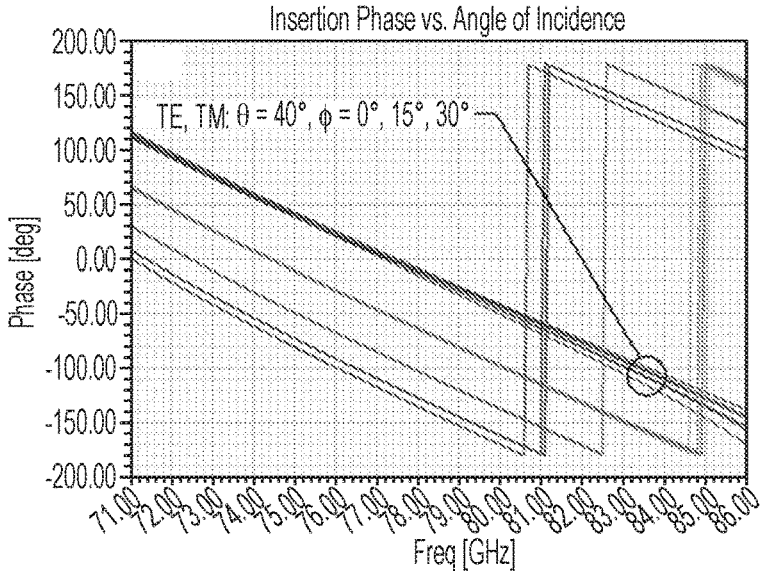
FIG. 7B illustrates insertion loss as a function of frequency for a metal radome.
Figure 7C:
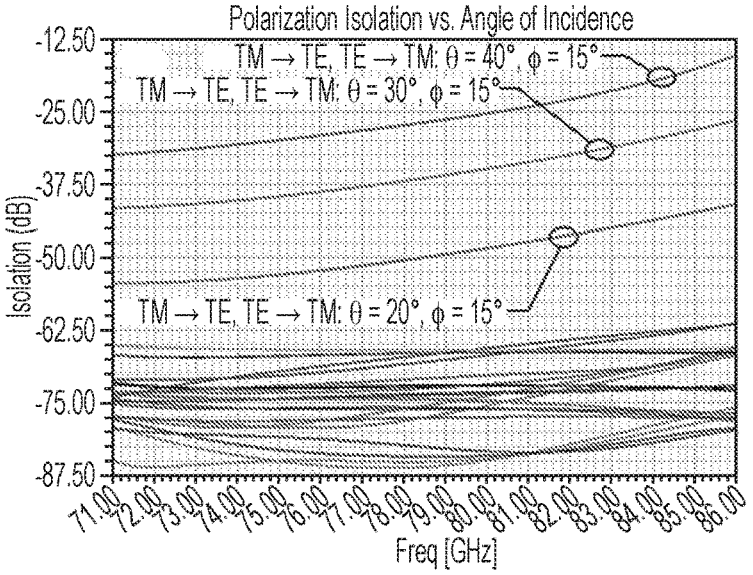
FIG. 7C illustrates insertion loss as a function of frequency for a metal radome.

FIGS. 7B and 7C are plots of the insertion phase and polarization isolation as functions of frequency and angle of incidence. The insertion phase plotted in FIG. 7B is a nearly linear function of frequency across the operating band, with deviation from linearity becoming significant only at the largest angles of incidence. Furthermore, the insertion phase is the same to within a few degrees for both incident polarizations at each incident angle ($\theta$, $\phi$). FIG. 7C displays the polarization isolation performance. Each trace in FIG. 7C represents the degree of polarization conversion from the incident polarization to the orthogonal polarization at the output. The degree of conversion is very low except at the largest angles of incidence. Insertion phase equality for orthogonal incident polarizations and minimal polarization conversion guarantees that the radome will not have a significant impact on the polarization. For example, the polarization of an incident circularly-polarized wave will be preserved following transmission through the radome. The impact of the radome on polarization may be of interest, for example, for communication applications in which orthogonal polarization states are used to transmit independent data streams.

Figure 8:
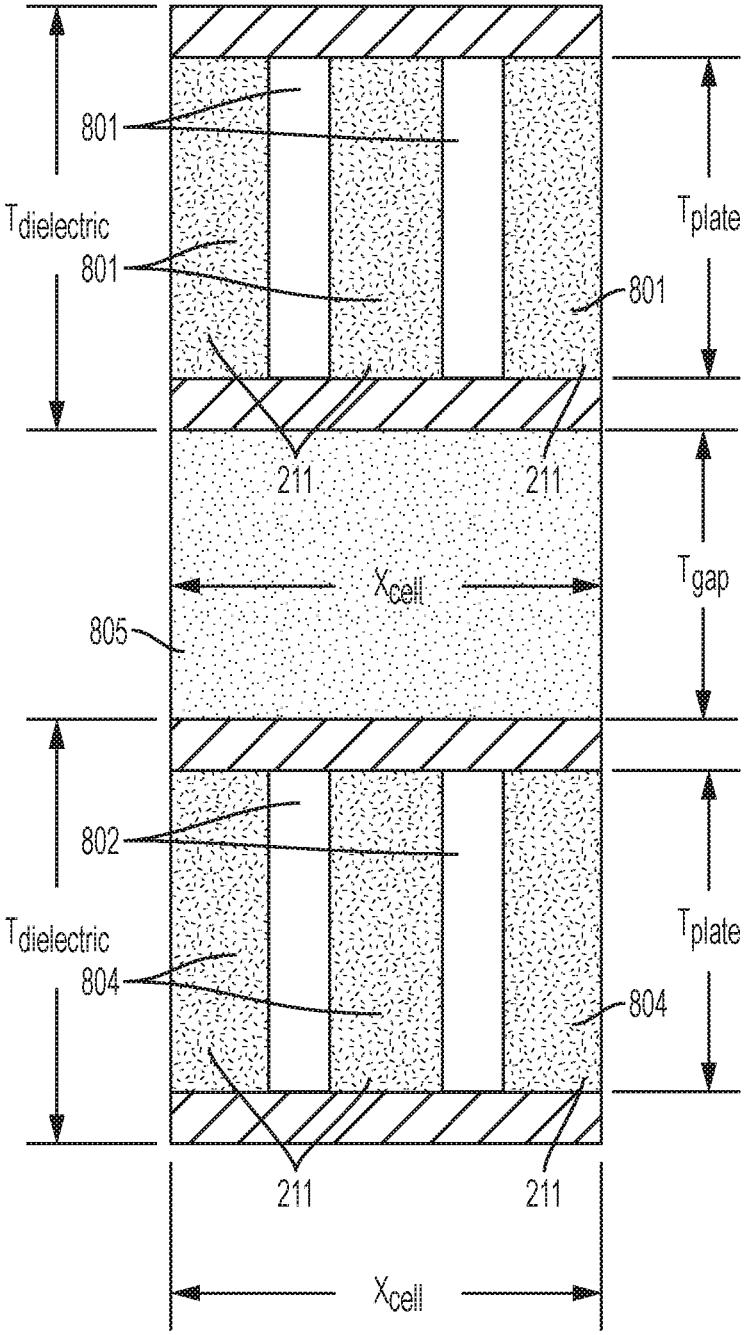
FIG. 8 is a side view of a single unit cell of a two-plate metal radome in accordance with embodiments.

With reference to FIG. 8, the perforated and plated metallic plate 20 can be combined with additional perforated and plated metallic plates 20 in order to enhance structural integrity. As shown in FIG. 8, a perforation 211 or a single unit cell of a radome structure is provided and incorporates first and second perforated and plated metallic plates 801 and 802 as well as first and second low-loss dielectric encapsulation materials 803 and 804 to encapsulate the first and second perforated and plated metallic plates 810 and 802, respectively. The first and second perforated and plated metallic plates 801 and 802 may be similar to one another or may have different structural features. In any case, a gap between the first and second perforated and plated metallic plates 801 and 802 may be filled with a dielectric filler 805, such as ultra-high molecular weight polyethylene (UHMWPE), which has a dielectric constant of 2.42 and a millimeter-wave loss tangent of $10^{-4}$, or another similar material.

The plate dimensions and the width of the dielectric-filled gap of the embodiment of FIG. 8 are listed in Table 2 and are chosen to yield optimized performance.

TABLE 2

| Parameter | Value |
|---|---|
| $X_{cell} = Y_{cell}$* cos(30 deg) | 129.33 mils |
| $Y_{cell}$ | 149.34 mils |
| $T_{wall}$ | 10 mils |
| $W_{hex}$ | 74.67 mils |
| $T_{plate}$ | 77.8 mils |
| $T_{dielectric}$ | 103.8 mils |
| $T_{gap}$ | 210.25 Mils mils |

Figure 9A:
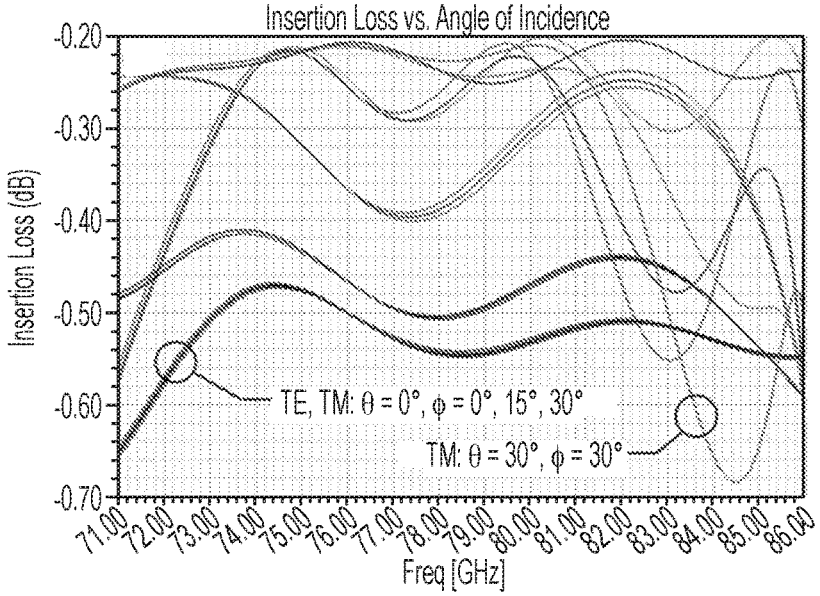
FIG. 9A illustrates insertion loss as a function of frequency for a metal radome.
Figure 9B:
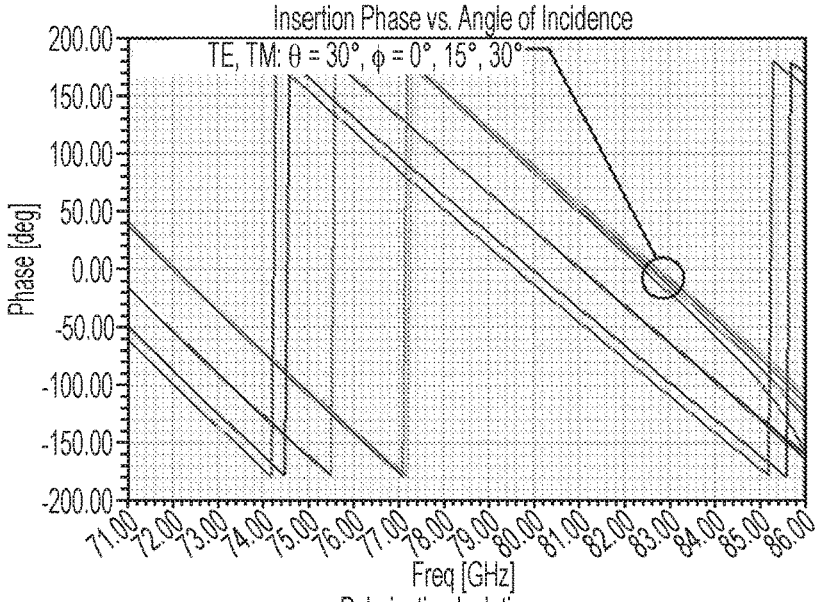
FIG. 9B illustrates insertion loss as a function of frequency for a metal radome.
Figure 9C:
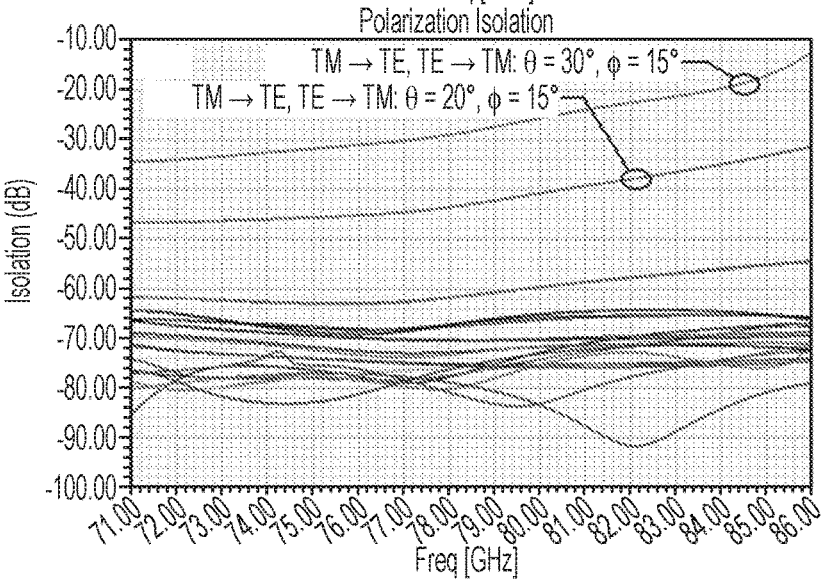
FIG. 9C illustrates insertion loss as a function of frequency for a metal radome.

In this case, plate performance was optimized not only over frequency but over angle as well. Calculated insertion losses for both TE and TM incident polarizations are plotted in FIGS. 9A, 9B and 9C as functions of frequency for different angles of incidence.

In accordance with further aspects, a method of assembling a low-loss millimeter-wave radome is provided. The method includes assembling the perforated and plated metallic plate 20 and encapsulating the perforated and plated metallic plate 20. As noted above, the assembling of the perforated and plated metallic plate 20 includes forming the multiple metallic sheets 21 in parallel by at least one of chemical machining and electroforming to respectively define the periodic array of sub-wavelength holes 210 and laminating the multiple metallic sheets 21 together such that the periodic array of sub-wavelength holes 210 combines into a periodic array of perforations 211.

In accordance with embodiments, the forming of the multiple metallic sheets 21 includes defining the periodic array of sub-wavelength holes 210 to have at least one of substantially uniform wall thicknesses between adjacent holes and azimuthal periodicity. In addition, the laminating of the multiple metallic sheets 21 together may include locating each of the multiple metallic sheets 21 relative to an adjacent metallic sheet by the location feature 212 and executing a diffusion bonding process with respect to each of the multiple metallic sheets 21 and each adjacent metallic sheet.

Figure 10A:
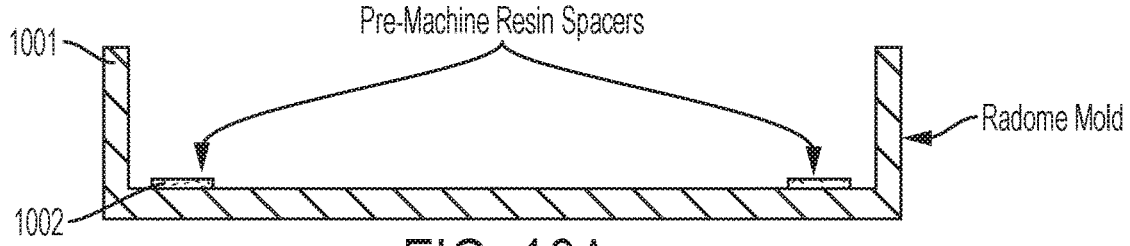
FIG. 10A is a side view illustrating a first stage in an injection molding process for a radome in accordance with embodiments.

With reference to FIGS. 10A-10D and in accordance with further embodiments, the encapsulating of the perforated and plated metallic plate 20 may include at least one of injection molding and vacuum injection molding so as to fill the perforations 211 and cover opposite major surfaces of the perforated and plated metallic plate 20. For the case of injection molding, as shown in FIG. 10A, a mold 1001 is initially created to contain resin and the low-loss millimeter-wave radome 10. A floor of the mold 1001 is designed to meet a flatness specification for the final radome surface. Spacers 1002 are then placed in the bottom of the mold 1001. The spacers 1002 may be made from cured resin and are machined to a desired thickness of solid layers 32 and 33.

Figure 10B:
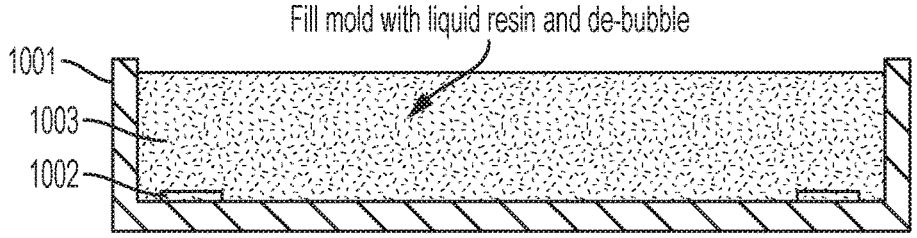
FIG. 10B is a side view illustrating an intermediate stage in an injection molding process for a radome in accordance with embodiments.
Figure 10C:
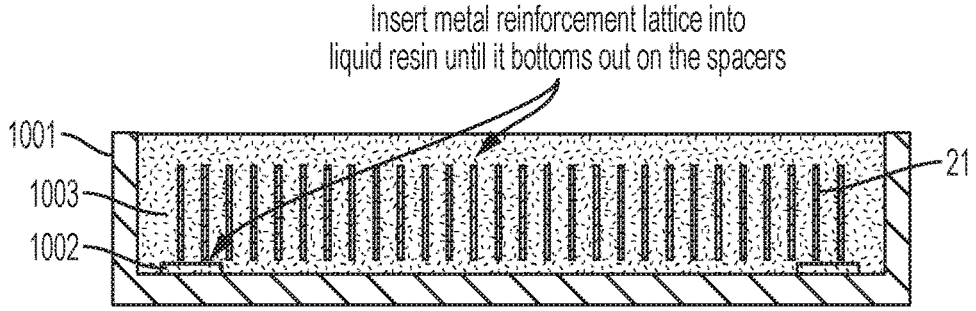
FIG. 10C is a side view illustrating an intermediate stage in an injection molding process for a radome in accordance with embodiments.

As shown in FIG. 10B, liquid resin 1003 is mixed, de-bubbled and poured into the mold 1001. Sufficient resin 1003 is used to fully cover the bonded metallic sheets 21 and leave excess on top beyond what is required in the finished part. Any bubbles created during pouring should be allowed to rise to the surface where they can be eliminated by fast exposure with a hot air gun. As shown in FIG. 10C, the bonded metallic sheets 21 are placed onto the surface of the resin 1003 and allowed to slowly settle onto the spacers 1002 to avoid entraining bubbles.

Figure 10D:
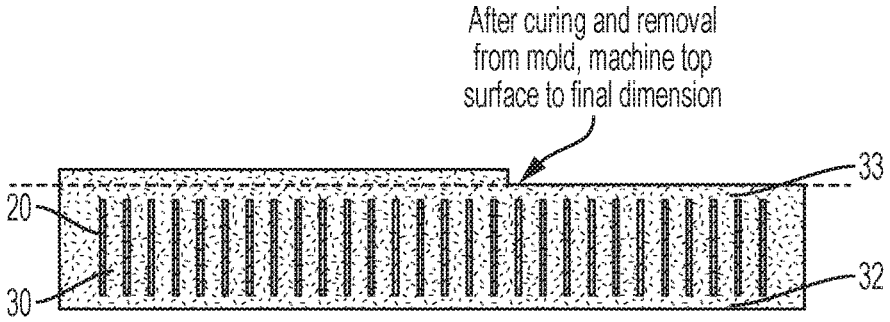
FIG. 10D is a side view illustrating a late stage in an injection molding process for a radome in accordance with embodiments.

As shown in FIG. 10D, the mold 1001 is placed into a curing oven and processed per the resin curing schedule. After cooling and de-molding, the top surface of the low-loss millimeter-wave radome 10 is machined to set the upper resin layer over the metal lattice to the final thickness of the solid layers 32 and 33.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts and equivalents of all means or step plus function elements in the claims below are intended to include any structure, material or act for performing the function in combination with other claimed elements as claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While embodiments have been described, it will be understood that those skilled in the art, both now and in the future, may make various improvements and enhancements which fall within the scope of the claims which follow. These claims should be construed to maintain the proper protection for the invention first described.

What is claimed is:

1. A low-loss millimeter-wave radome, comprising:

a perforated and plated metallic plate; and a low-loss dielectric encapsulation material to encapsulate the perforated and plated metallic plate, the perforated and plated metallic plate comprising multiple metallic sheets and electrically conductive plating, and the multiple metallic sheets respectively defining a periodic array of sub-wavelength holes and being laminated together such that the periodic array of sub-wavelength holes combines into a periodic array of perforations, wherein the electrically conductive plating is disposed on interior facing surfaces of each of the perforations of the periodic array and the low-loss dielectric encapsulation material comprises filler material that entirely fills each of the perforations of the periodic array having the electrically conductive plating disposed on respective interior facing surfaces thereof, wherein each of the multiple metallic sheets defines a hexagonal lattice of hexagonal holes.

2. The low-loss millimeter-wave radome according to claim 1, wherein each of the multiple metallic sheets comprises locating features.

3. The low-loss millimeter-wave radome according to claim 1, wherein each of the multiple metallic sheets is diffusion bonded to an adjacent metallic sheet and the electrically conductive plating is disposed on interior facing surfaces of each of the perforations of the periodic array.

4. The low-loss millimeter-wave radome according to claim 1, wherein the periodic array of sub-wavelength holes has at least one of substantially uniform wall thicknesses between adjacent holes and azimuthal periodicity.

5. The low-loss millimeter-wave radome according to claim 1, wherein the low-loss dielectric encapsulation material comprises layered material that covers opposite major surfaces of the perforated and plated metallic plate.

6. The low-loss millimeter-wave radome according to claim 1, wherein the low-loss dielectric encapsulation material has a low-loss tangent.

7. The low-loss millimeter-wave radome according to claim 1, wherein the low-loss dielectric encapsulation material is at least one of polymeric and a cyanate ester resin.

8. The low-loss millimeter-wave radome according to claim 1, further comprising an outer layer of low-loss dielectric material.

* * * * *